US010688508B2

(12) United States Patent
Scheibner et al.

(10) Patent No.: US 10,688,508 B2
(45) Date of Patent: Jun. 23, 2020

(54) NOZZLE ASSEMBLY WITH EXTERNAL BAFFLES

(71) Applicant: 3M INNOVATIVE PROPERTIES COMPANY, St. Paul, MN (US)

(72) Inventors: John B. Scheibner, Woodbury, MN (US); Daniel Siltberg, White Bear Township, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/316,893

(22) PCT Filed: Jun. 1, 2015

(86) PCT No.: PCT/US2015/033581

§ 371 (c)(1),
(2) Date: Dec. 7, 2016

(87) PCT Pub. No.: WO2015/191323

PCT Pub. Date: Dec. 17, 2015

(65) Prior Publication Data

US 2017/0120269 A1 May 4, 2017

Related U.S. Application Data

(60) Provisional application No. 62/010,214, filed on Jun. 10, 2014.

(51) Int. Cl.

| | |
|---|---|
| ***B05B 7/08*** | (2006.01) |
| ***B05B 12/00*** | (2018.01) |
| *B05B 7/24* | (2006.01) |

(52) U.S. Cl.

CPC ..... *B05B 7/0815* (2013.01); *B05B 12/002* (2013.01); *B05B 7/2478* (2013.01)

(58) Field of Classification Search

CPC .... B05B 7/0815; B05B 7/2478; B05B 12/002

(Continued)

(56) References Cited

U.S. PATENT DOCUMENTS

| | | | |
|---|---|---|---|
| 1,731,497 | A | 10/1929 | Mueller |
| 2,304,857 | A | 12/1942 | Stahl |

(Continued)

FOREIGN PATENT DOCUMENTS

| | | |
|---|---|---|
| CA | 2569369 | 7/1998 |
| DE | 2705642 | 8/1978 |

(Continued)

OTHER PUBLICATIONS

International Search Report for PCT International Application No. PCT/US2015/033581, dated Sep. 11, 2015, 3 pages.

*Primary Examiner* — Christopher S Kim

(57) ABSTRACT

Provided are nozzle assemblies and related methods for a spraying apparatus. The nozzle assembly includes a fluid side wall defining a fluid passageway that extends longitudinally along a fluid axis and terminates in a fluid aperture; an air cap side wall extending around the fluid side wall and partially defining an air passageway that terminates in an atomizing aperture adjacent the fluid aperture. A pair of diametrically opposed air horns protrude past the fluid aperture from the air cap side wall and define respective air horn cavities in communication with the air passageway, each air horn having an external surface and a fan control aperture extending along a fan control axis through the external surface to flow air against a fluid stream discharged from the fluid aperture. The fan control aperture has a certain aperture shape defined along a reference plane perpendicular to the fan control axis, and for each air horn, a baffle projects into a volumetric shape defined by extruding the certain aperture shape outwardly along the fan control axis. The (Continued)

baffle modifies the shaping air jets between the fan control apertures and the atomized fluid stream to provide a refined spray pattern.

14 Claims, 8 Drawing Sheets

(58) Field of Classification Search
USPC ..... 239/295, 296, 299, 300, 502, 505, 521, 239/522
See application file for complete search history.

(56) References Cited

U.S. PATENT DOCUMENTS

| | | | |
|---|---|---|---|
| 3,693,882 | A | 9/1972 | Watanabe et al. |
| 4,102,501 | A | 7/1978 | De Gelder et al. |
| 5,456,414 | A | 10/1995 | Burns et al. |
| 6,588,681 | B2 | 7/2003 | Rothrum et al. |
| 6,663,018 | B2 | 12/2003 | Rothrum et al. |
| 7,188,785 | B2 | 3/2007 | Joseph et al. |
| 7,201,336 | B2 | 4/2007 | Blette et al. |
| 7,815,130 | B2 | 10/2010 | Joseph et al. |
| 9,352,341 | B2 | 5/2016 | Reitz |
| 2010/0123024 | A1 | 5/2010 | Göhring et al. |
| 2013/0092760 | A1 | 4/2013 | Joseph et al. |

FOREIGN PATENT DOCUMENTS

| | | |
|---|---|---|
| JP | S56-07864 | 6/1981 |
| JP | S64-021762 | 2/1989 |
| JP | H01-077863 | 5/1989 |
| JP | H07-003736 | 1/1995 |
| WO | WO 2010/085801 | 7/2010 |
| WO | WO 2014/067058 | 5/2014 |

NOZZLE ASSEMBLY WITH EXTERNAL BAFFLES

CROSS REFERENCE TO RELATED APPLICATIONS

This application is a national stage filing under 35 U.S.C. 371 of PCT/US2015/033581, filed Jun. 1, 2015, which claims the benefit of U.S. Provisional Application No. 62/010,214, filed Jun. 10, 2014, the disclosures of which are incorporated by reference in their entireties herein.

FIELD OF THE INVENTION

Provided are nozzle assemblies along with related systems and methods for spraying apparatus. More particularly, the provided nozzle assemblies are for use in spray guns, spray gun platforms, and spray head assemblies.

BACKGROUND

Handheld spray guns are devices that project a fine mist of fluid particles through the air and onto a substrate. A pressurized gas, such as air, is used to atomize and direct the fluid particles. High Volume Low Pressure spray guns, for example, have the advantage of reduced overspray and materials consumption and thus are preferred in a variety of commercial and industrial applications. Applications may include any of a wide variety of coating media, including primers, paints, clearcoats, slurries, fine powders, and other sprayable coating fluids. Notable applications for spray guns include painting and texturizing architectural surfaces such as walls and ceilings, furniture finishing, cosmetics, and painting and body repair for marine and automotive exteriors.

One type of spray gun uses a gun platform connected with a compressed air source and fluid passageway in communication with a spray nozzle. The air and liquid are generally directed into respective flow channels and expelled from the gun through adjacent atomizing and fluid apertures, respectively. The fast moving air flows out of the atomizing apertures through a region of reduced pressure, which in turn assists in drawing out the coating fluid from the fluid aperture and atomizing it to form a directed stream of fluid droplets.

To provide enhanced spray coverage when sweeping the spray gun over a large area, spray guns commonly incorporate a pair of air horns that receive a portion of the pressurized air supplied to the spray gun. These air horns are positioned on opposite sides of the fluid stream as it leaves the spray nozzle and have apertures (called fan control apertures) that direct air jets from opposing directions to flatten the shape of the fluid stream, thereby modifying the spray pattern achieved.

SUMMARY

One technical problem associated with spray guns that use air horns to flatten the fluid stream discharged from the nozzle relates to spray density. To obtain a uniform coating on a substrate, it is advantageous to maintain a predictable spray density along the length of the spray pattern while avoiding abrupt changes in spray density. When there is even a slight misalignment in the shaping air jets provided by the air horns with respect to each other or the fluid stream, "banding" can occur, as manifested by sharp density transitions along the long dimension of the spray pattern.

Banding greatly complicates the challenge of obtaining a uniform coverage on the substrate, even after making multiple passes with the spray gun.

The problem of banding can be substantially alleviated by incorporating auxiliary apertures in the spray nozzle generally located between the atomizing aperture and the fan control apertures of the air horns. These auxiliary apertures direct secondary air jets against the shaping air jets provided by the air horns thereby diffusing or otherwise modifying the latter air jets, yielding a more predictable and stable spray pattern. Although auxiliary apertures display many benefits, they also have shortcomings such as a limited ability to manipulate the shaping air jets, reduction in air usage efficiency of the spray gun, and manufacturing difficulties.

An alternative solution to banding that is unaffected by the above tradeoffs can be realized by positioning one or more baffles that modify the shaping air jets between the fan control apertures and the atomized fluid stream. These baffles can assume any of a wide variety of configurations to optimally adjust the shaping air jets, do not deplete any air from the spray gun, and can be readily manufactured by molding or other polymer processing methods. Further, baffles provide an outboard device capable of partially, or even completely, deflecting or blocking air flow from the fan control apertures. A baffled spray gun nozzle therefore allows for the possibility of eliminating separate air passages located within the spray gun platform for regulating the shaping air flow. This in turn provides an opportunity to obtain a spray gun having a simplified, lower weight, and aerodynamically efficient system architecture compared with spray guns in the prior art.

In one aspect, a nozzle assembly for a spraying apparatus is provided. The nozzle assembly comprises: a fluid side wall defining a fluid passageway that extends longitudinally along a fluid axis and terminates in a fluid aperture; an air cap side wall extending around the fluid side wall and partially defining an air passageway that terminates in an atomizing aperture adjacent the fluid aperture; a pair of diametrically opposed air horns protruding past the fluid aperture from the air cap side wall and defining respective air horn cavities in communication with the air passageway, each air horn having an external surface and a fan control aperture extending along a fan control axis through the external surface to flow air against a fluid stream discharged from the fluid aperture, wherein the fan control aperture has a certain aperture shape defined along a reference plane perpendicular to the fan control axis; and for each air horn, a baffle projecting into a volumetric shape defined by extruding the certain aperture shape outwardly along the fan control axis.

In another aspect, a nozzle assembly for a spraying apparatus is provided, comprising: a fluid side wall defining a fluid passageway that extends longitudinally along a fluid axis and terminates in a fluid aperture; an air cap side wall extending around the fluid side wall and partially defining a first air passageway that terminates in an atomizing aperture adjacent the fluid aperture; a pair of diametrically opposed air horns protruding past the fluid aperture from the air cap side wall and defining respective air horn cavities in communication with a second air passageway, each air horn having an external surface and a fan control aperture extending along a fan control axis through the external surface to flow air against a fluid stream discharged from the fluid aperture, wherein each fan control aperture has an aperture shape defined along a reference plane perpendicular to the fan control axis; and an annular baffle rotatably coupled to the air cap side wall and projecting into a pair of volumetric shapes, each volumetric shape defined by extruding each aperture shape outwardly along its respective fan control axis.

In still another aspect, a method of adjusting a spray pattern of a spraying apparatus having a fluid aperture and a pair of diametrically opposed air horns projecting past the fluid aperture, each air horn including a fan control aperture, is provided, the method comprising: providing a pair of baffles extending outwardly from respective air horns, wherein each baffle extends into a volumetric shape defined by extruding the shape of its respective fan control aperture outwardly along its fan control axis; and discharging a fluid stream from the fluid aperture while simultaneously flowing air from the fan control apertures against the fluid stream from opposing directions, wherein the pair of baffles modify the flowing air before the air impinges against the fluid stream, thereby producing a modified spray pattern.

The above summary is not intended to describe each embodiment or every implementation of the reservoirs and associated vent assemblies described herein. Rather, a more complete understanding of the invention will become apparent and appreciated by reference to the following Detailed Description and Claims in view of the accompanying figures of the drawing.

DEFINITIONS

"Centroid" refers to the geometric center point of a shape which minimizes the sum of squared Euclidean distances to all points over the entire shape.

"Pressurized gas" refers to gas under greater than atmospheric pressure.

DETAILED DESCRIPTION

As used herein, the terms "preferred" and "preferably" refer to embodiments described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Figure 1:
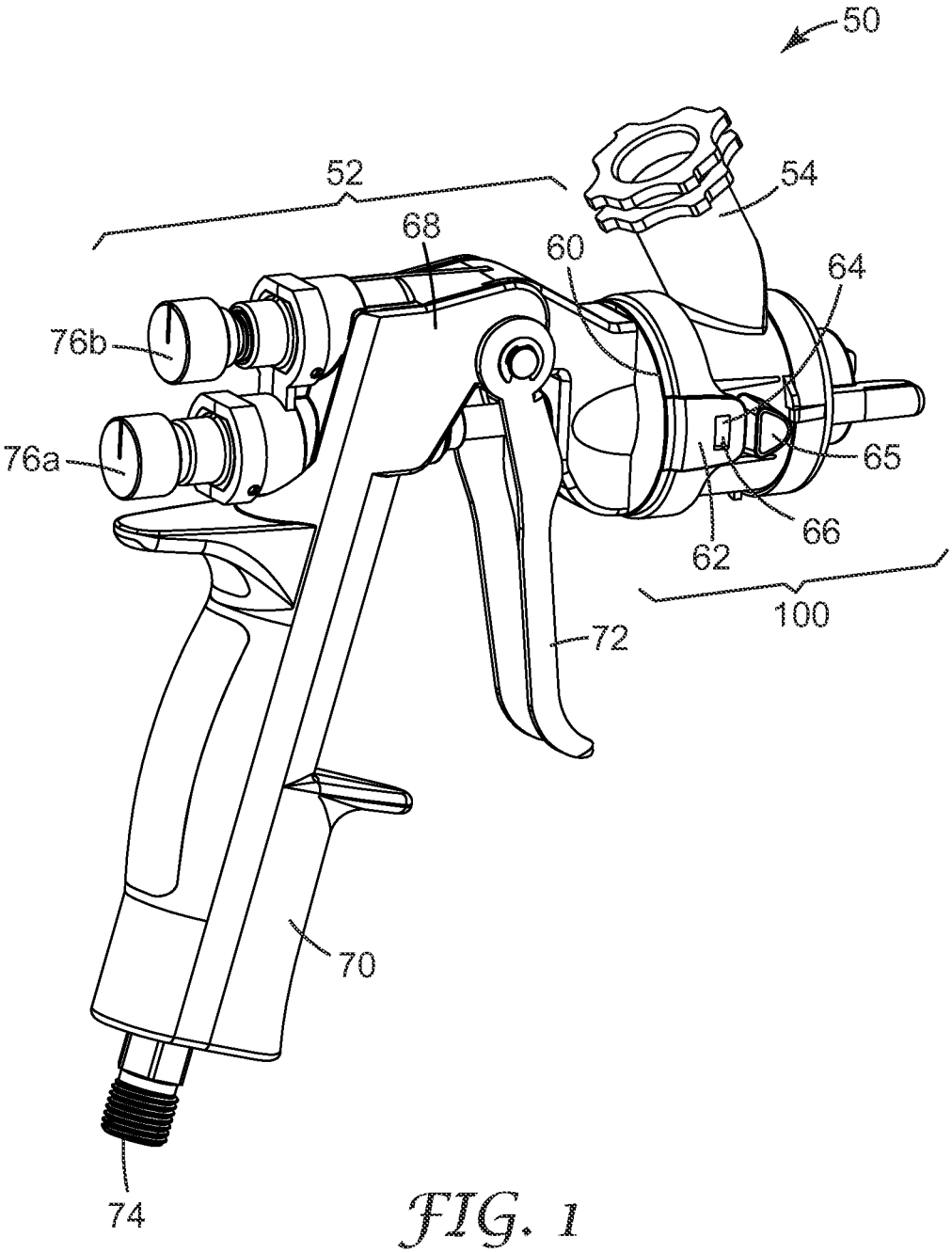
FIG. 1 is a perspective view of a spray gun including a baffled nozzle assembly according to one exemplary embodiment, showing the rear and side surfaces of the assembly.

A spraying apparatus according to one exemplary embodiment is shown in FIG. 1 and broadly designated by the numeral 50. The spraying apparatus 50 includes a spray gun platform 52 operatively coupled to a nozzle assembly 100. Optionally, the nozzle assembly 100 is releasably connected to the spray gun platform 52, allowing the former to be conveniently detached and cleaned. In a preferred embodiment, the nozzle assembly 100 is made from plastic and may be discarded or recycled at the end of a spraying operation.

Extending outwardly from the top of the nozzle assembly 100 is a fluid inlet 54 operatively connected to a fluid container (not shown). The spraying apparatus 50, as shown, is a gravity-fed spray gun in which the fluid container is located above the spray gun platform 52 to facilitate the flow of fluid into the spray gun platform 52. The spraying apparatus 50 need not be gravity fed. For example, the fluid inlet 54 can be connected to a fluid source under pressure so that the fluid can be fed from below. In high volume applications, the fluid inlet 54 can be connected to a hose that conveys fluid from an external pressurized pot. Various types of fluid containers and their modes of use have been previously described, for example, in U.S. Pat. No. 6,588,681 (Rothrum et al.), U.S. Pat. No. 6,663,018 (Rothrum et al.), U.S. Pat. No. 7,188,785 (Joseph et al.), U.S. Pat. No. 7,815,130 (Joseph et al.), and co-pending International Application No. WO 2014/067058 (Nyaribo et al.), filed on Nov. 24, 2014.

In FIG. 1, and as described in published International Application No. WO 2010/085801 (Escoto et al.), the fluid inlet 54 is itself incorporated into the nozzle assembly 100 to avoid directing the fluid through the spray gun platform 52. Since the fluid to be sprayed does not pass through the spray gun platform 52, cleaning of the spray gun platform 52 is rendered unnecessary, saving operator time and labor. As a further advantage, the spraying apparatus 50 can be converted over to dispense a different fluid, if desired, by swapping out the nozzle assembly with another that is outfitted with a different fluid container.

The connection at the spray gun interface 60 between the nozzle assembly 100 and the spray gun platform 52 enables fluid communication between their respective interior cavities and can be achieved using any attachment mechanism known in the art. In the embodiment shown, the spray gun platform 52 includes mating connection features that mechanically interlock to the nozzle assembly 100 at the spray gun interface 60, thus providing a releasable connection in which an air-tight seal can be achieved between interior chambers of these components.

In some embodiments, the spray gun platform 52 and nozzle assembly 100 are interconnected by an interference fit. To this end, the former includes a pair of flexible connection tabs 62 having respective openings 64. As the spray gun platform 52 and nozzle assembly 100 are mutually engaged, the connection tabs 62 flex outwardly to snap over matching retaining projections 66 located on the nozzle assembly 100. To facilitate this process, the operator can also pinch buttons 65 in directions toward each other to depress the projections 66. The mating engagement between the openings 64 and the retaining projections 66 prevents the nozzle assembly 100 from becoming inadvertently detached. Alternatively or in combination, other mechanisms can be used, such as bayonet-type fixtures, clamps, collars, magnets, and threaded connections.

Referring again to FIG. 1, the spray gun platform 52 includes a frame 68, and a pistol-grip handle 70 and trigger 72 connected to the frame 68. Extending outwardly from the bottom of the handle 70 is a threaded air inlet port 74 for connection to a suitable source of pressurized gas, the gas typically being air. As used herein, "pressurized gas" refers to gas under greater than atmospheric pressure. Optionally and as shown, the trigger 72 is pivotally connected to the frame 68 and biased in its forward-most position. While holding the handle 70, an operator can depress the trigger 72 to dispense the coating fluid from the spraying apparatus 50.

Optionally, a center air regulator **76*a* and fan control regulator 76*b* can be built into the rear-facing surface of the frame 68 to adjust the pressure of gas flowing from the spray gun platform 52 into the nozzle assembly 100. In this exemplary embodiment, the fan control regulator 76*b* is a rotatable knob that allows an operator to control air flow to a pair of air horns used to adjust the spray pattern geometry. The center air regulator 76*a* can be adjusted so as to limit the longitudinal travel distance of a fluid needle associated with a needle valve (not visible) located within the spraying apparatus 50. The travel of the fluid needle can affect both fluid flow and center air flow (atomization air). These features, and others, are further described in International Application No. WO 2010/085801. Advantageously, and as will be described later, the provided nozzle assembly 100 can enable the fan control regulator 76*b*** to be omitted in certain applications.

Figure 2:
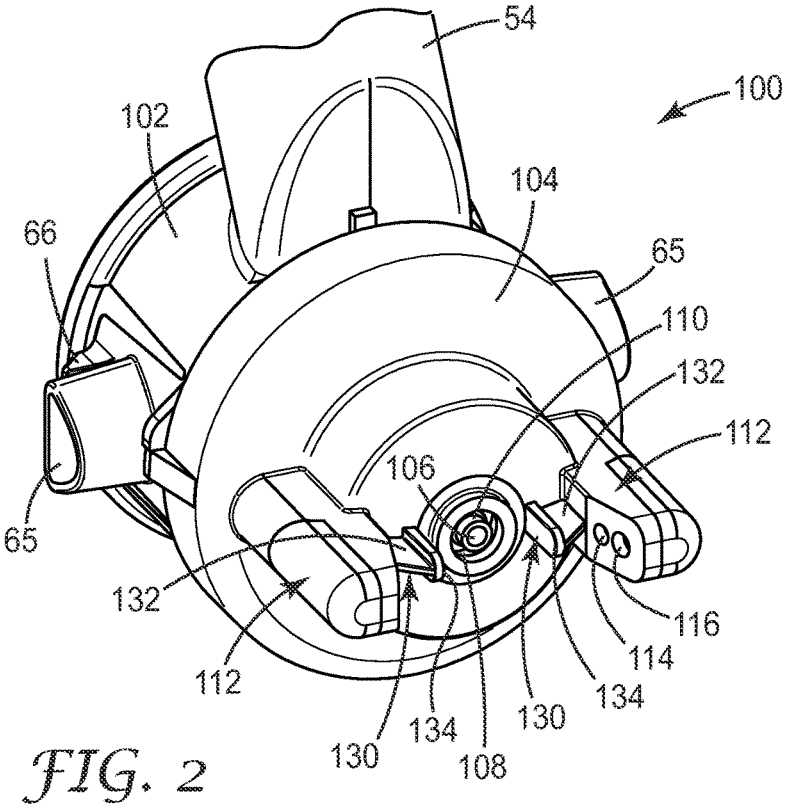
FIG. 2 is a front perspective view of a nozzle assembly of the spray gun of FIG. 1, showing its right side, front, and top surfaces.
Figure 3:
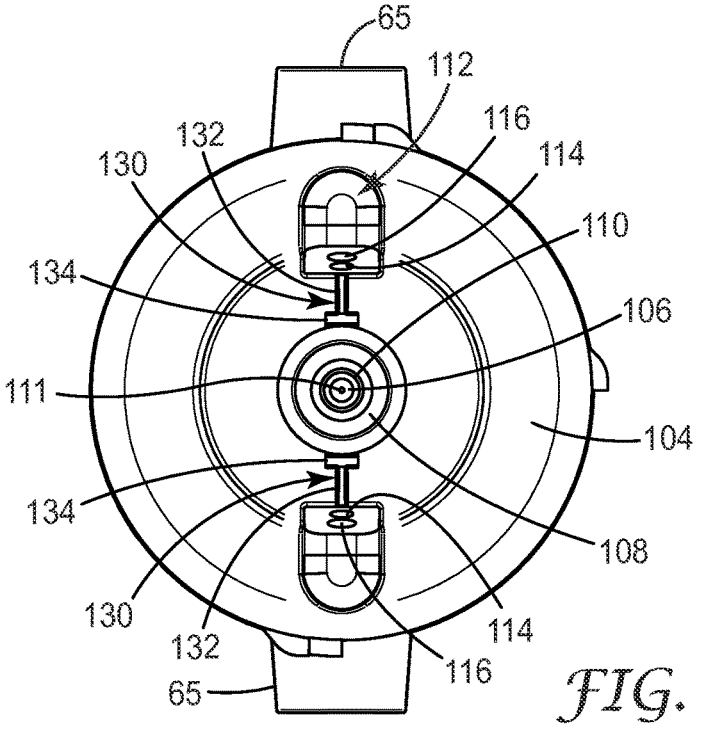
FIG. 3 is a front elevational view of the nozzle assembly of FIGS. 1-2, showing its front surface.

FIGS. 2 and 3 provide enlarged views showing features of the nozzle assembly 100 in more detail. As shown, the nozzle assembly 100 includes a barrel 102 and an air cap 104 located in front of the barrel 102. Optionally and as shown, the air cap 104 is rotatably coupled to the distal end of the barrel 102 in encircling relation, permitting a 90 degree range of relative rotation between these components. In a simplified alternative, the air cap 104 could be fixed relative to the barrel 102 or even formed as an integral component of the barrel 102.

Centrally located on the front surface of the air cap 104 are a pair of concentric apertures, a circular fluid aperture 106 and an annular atomizing aperture 108 adjacent to, and surrounding, the fluid aperture 106. The apertures 106, 108 are separated by a generally cylindrical fluid side wall 110. In this exemplary embodiment, each of the apertures 106, 108 and fluid side wall 110 are concentrically disposed about a fluid axis 111, shown in FIGS. 3 and 4. The apertures 106, 108 may vary in shape, size, and relative orientation from that depicted here. For example, the atomizing aperture 108 need not be annular and may only partially surround the fluid aperture 106. Further, two or more fluid apertures 106 or atomizing apertures 108 could be implemented if so desired.

Figure 4:
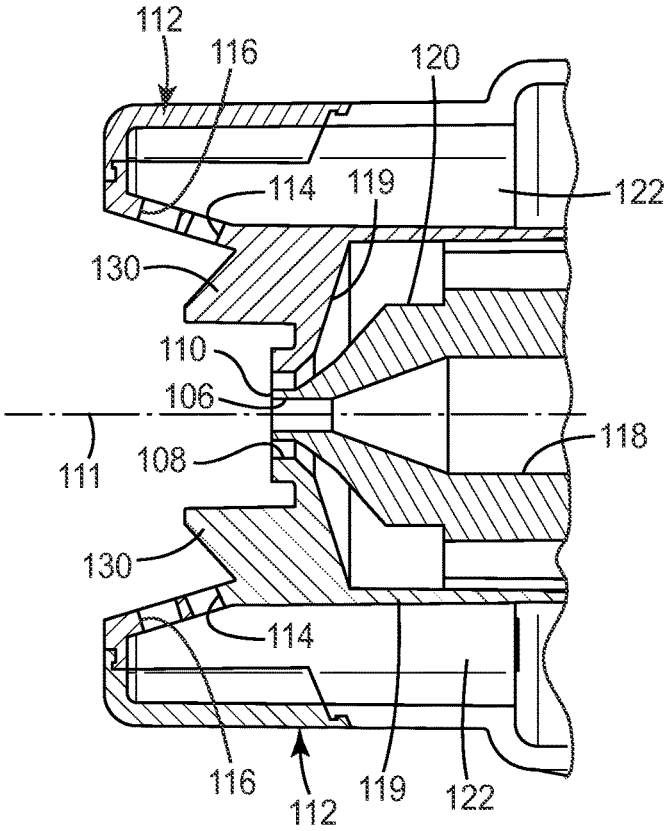
FIG. 4 is a fragmentary, side cross-sectional view of the nozzle assembly of FIGS. 1-3.

The basic principle of operation of the spraying apparatus 50 can be described with reference to the cross-sectional view of FIG. 4. As illustrated, an internal fluid passageway 118 (defined in part by the fluid side wall 110) and a first air passageway 120 (defined in part by the side wall of the air cap 104) both extend longitudinally along the fluid axis 111. The fluid passageway 118 and first air passageway 120 initiate at the spray gun interface 60 and terminate at the fluid aperture 106 and atomizing aperture 108, respectively. Optionally, one or both passageways 118, 120 have configurations that are generally symmetric about the fluid axis 111 in the vicinity of the apertures 106, 108. Visible in this cross-sectional view is an internal side wall 119, which extends around the fluid side wall 110 and defines peripheral surfaces of the first air passageway 120. Optionally and as shown, the internal side wall 119 is generally cylindrical in shape, although other shapes are also possible.

When the trigger 72 is depressed, air is injected under pressure through the spray gun interface 60 and accelerates as it enters regions of decreasing cross-section before being expelled from the atomizing aperture 108. Based on the Venturi effect, this results in a pressure drop in front of the atomizing aperture 108, which can help draw coating fluid (e.g. paint) out of the fluid passageway 118 through the fluid aperture 106. Upon encountering the moving air, the coating fluid is then atomized—that is, projected from the nozzle assembly 100 as a fine spray of droplets. Alternatively or in combination, the coating fluid may also be urged through the fluid aperture 106 by gravity or by pressurizing the coating fluid within the fluid container.

Referring again to FIGS. 2-4, a pair of air horns 112 extend outwardly in the forward direction from the air cap 104 and protruding past both the fluid aperture 106 and atomizing aperture 108. In this embodiment, the air horns 112 are integrally formed as part of the air cap 104, and stand diametrically opposed on opposite sides of the fluid axis 111. Each air horn 112 defines a respective air horn cavity in communication with a second air passageway 122 that terminates in a generally circular inner fan control aperture 114 and adjacent outer fan control aperture 116. The fan control apertures 114, 116 extend through the external surface of the air horn 112 and serve to discharge pressurized air from the cavity within the air cap 104. Optionally, only one fan control aperture is present on each air horn 112. As a further option, either or both of the fan control apertures 114, 116 may assume non-circular shapes, as described in U.S. Pat. No. 7,201,336 (Blette et al.).

During operation of the spraying apparatus 50, where a fluid stream is being discharged from the fluid aperture 106, the air horns 112 enable simultaneous air flow from the fan control apertures 114, 116 against the fluid stream from opposing directions to flatten the airborne spray profile and improve operator control over the resulting spray pattern.

In some embodiments, the air pressure driving the flow of air from the fan control apertures 114, 116 is independently regulated from the air pressure used to atomize the fluid to be dispensed from the spraying apparatus 50. For example, this can be achieved when the atomizing aperture 108 and fan control apertures 114, 116 are isolated from each other within the nozzle assembly 100. This can be achieved be using discrete first and second air passageways 120, 122 having internal air pressures that are independently regulated, thus allowing a pressure differential to be maintained between them. Alternatively, the same volume of pressurized air can be used for both functions; for example, the first and second air passageways 120, 122 can be in communication with each other within the nozzle assembly 100. For example, both of the first and second air passageways 120, 122 could communicate with a common plenum adjacent the spray gun interface 60. This configuration allows air to flow between the first and second air passageways 120, 122, enabling both passageways to be pressurized using a single conduit on the spray gun platform 52. The apportionment of air flowing into the nozzle assembly 100 can be controlled, at least in part, by the geometry of the first and second air passageways 120, 122.

As further shown in FIGS. 1-4, a pair of baffles 130 are positioned within the volumetric space facing one or both fan control apertures 114, 116 of respective air horns 112. In this exemplary embodiment, each of the baffles 130 has a fin portion 132 generally coplanar with the fluid axis 111 parallel to the fan control air flow and a plate portion 134 oriented perpendicularly to the fin portion 132. As shown, the plate portion 134 is spatially offset from the fluid axis 111 and directly faces the fan control air flow. Optionally and as shown, each baffle 130 is coupled to both its respective air horn 112 and also a front-facing side wall of the air cap 104. Here, the fin portion 132 extends radially along the side wall of the air cap 104 proximate the atomizing aperture 108.

The baffles 130 have a size, shape and orientation enabling them to substantially modify the air flow discharged from one or both pairs of fan control apertures 114, 116. The effect of this modification is manifested when the nozzle assembly 100 is discharging a fluid stream from the fluid aperture 106 while air is flowing from the fan control apertures 114, 116 against the fluid stream from opposing directions. The baffles 130 disrupt the flowing air before the fan control air impinges against the fluid stream, resulting in a modified spray profile, or plume, emanating from the spraying apparatus 50. This modified spray profile in turn alters the spray pattern that appears on the substrate. As will be described later, the spray pattern can be altered to change its size, shape, density (or intensity), distribution, and combinations thereof.

Figure 5:
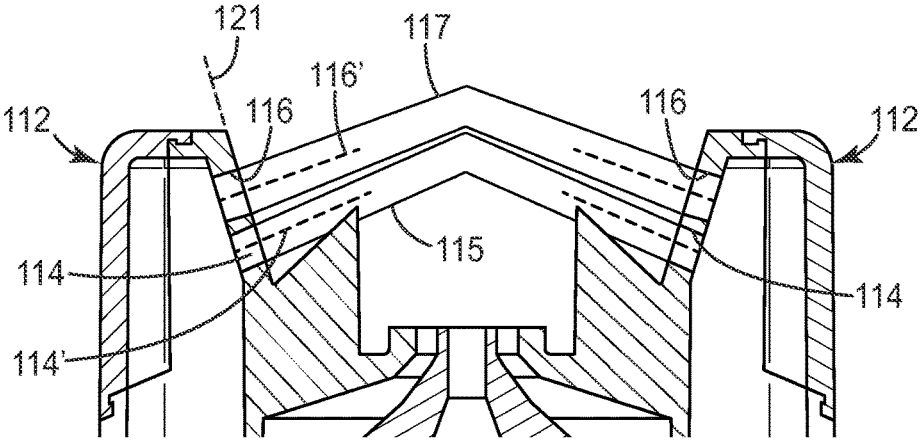
FIG. 5 is an enlarged fragmentary, side cross-sectional view of the nozzle assembly of FIGS. 1-4, showing a geometric relation between components.

FIG. 5 shows an enlarged view of the air horns 112 on the nozzle assembly 100 to illustrate more precisely the configuration of the baffles 130 relative to the fan control apertures 114, 116. As shown, the fan control apertures 114, 116 disposed on the air horns 112 are generally cylindrical and extend through the external surfaces of the air horns 112 along respective fan control axes 114', 116' (i.e. cylindrical axes). Each aperture 114, 116 also has an associated cross-sectional aperture shape that is defined along a common reference plane 121 perpendicular to respective fan control axis 114', 116'. Here, the aperture shape is generally circular.

It is noted that reference planes associated with the fan control axes 114', 116' need not be coplanar, or even parallel.

The envelope of the air stream discharged from the apertures 114, 116 can be characterized by respective cylindrical projections defining a virtual inner volumetric shape 115 and outer volumetric shape 117, respectively. As shown in FIG. 5, the inner and outer volumetric shapes 115, 117 are located adjacent to, and downstream from, apertures 114, 116. The volumetric shapes 115, 117 are defined by extruding the cross-sectional shapes of the apertures 114, 116, beginning at the external surface of the air horn 112, outwardly in the air flow direction along respective fan control axes 114', 116'. Each volumetric shape 115, 117 is closed on one end and has parallel side walls when viewed perpendicular to the fan control axis 114', 116'. The extrusion operation used to create the volumetric shapes 115, 117 can be easily implemented using any of a number of CAD/CAM software solutions including, for example, SolidWorks Professional (available from Dassault Systèmes SolidWorks Corporation in Waltham, Mass.).

As mentioned earlier, the apertures 114, 116 have a circular cross-section, but alternative shapes are possible. If one or both of the apertures 114, 116 has a cross-sectional shape that is elliptical, polygonal (e.g. rectangular), or some irregular shape, the fan control axis 114', 116' can be more generally defined as a line that passes through the centroid of a respective cross-sectional aperture shape and extends longitudinally along the direction of the air flow through the respective aperture 114, 116 during a spraying operation.

In the illustrated embodiment, the baffle 130 connected to each air horn 112 projects into respective volumetric shape 115 but does not project into respective volumetric shape 117. This has the effect of substantially disrupting the three-dimensional air flow pattern emanating from the inner fan control aperture 114 while avoiding interference with that of the outer fan control aperture 116. Optionally but not shown, the baffles 130 may project into both of the volumetric shapes 115, 117. While it is generally preferred that the baffles 130 and fan control apertures 114, 116 are disposed symmetrically on opposing sides of the fluid axis 111, it is envisioned that the baffles 130 can intersect with one or both of the volumetric shapes 115, 117 to varying degrees relative to each other. Of course, the outer fan control apertures 116 could also be omitted from the air horns 112 entirely.

In some embodiments, each baffle 130 occludes at least 1 percent, at least 2 percent, at least 5 percent, at least 10 percent, or at least 15 percent of the cross-section of one or both volumetric shapes 115, 117 as viewed along directions parallel respective fan control axis 114', 116'. In some embodiments, the baffle 130 occludes up to 100 percent, up to 75 percent, up to 50 percent, up to 40 percent, up to 30 percent, or up to 20 percent of the cross-section of one or both volumetric shapes 115, 117, as viewed along directions parallel respective fan control axis 114', 116'.

Measured another way, the baffle 130 could protrude into respective volumetric shape 115, 117 by an amount that is at least 1 percent, at least 2 percent, at least 5 percent, at least 10 percent, or at least 15 percent of the diameter of respective fan control aperture 114, 116 (as defined along common reference plane 121). In the same or other embodiments, the baffle 130 can protrude into the volumetric shape 115, 117 by an amount that is up to 100 percent, up to 75 percent, up to 50 percent, up to 40 percent, or up to 30 percent of the diameter of respective fan control aperture 114, 116. In some embodiments, the extent of protrusion is such that each fan control axis 114' intersects a respective baffle 130.

Figure 6:
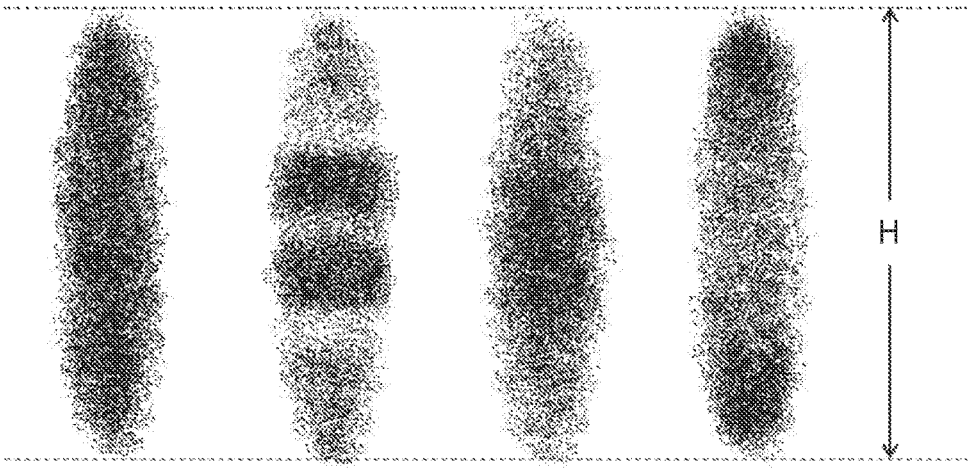
FIG. 6 is a comparison of spray patterns obtained using various nozzle assemblies, including the baffled nozzle assembly of FIGS. 1-5.

FIG. 6 shows a series of exemplary spray patterns on a substrate obtained at different spray gun inlet pressures, which affect both the shaping air jets and the atomizing air jet. In this figure, each of the depicted spray patterns were flattened/elongated through operation of fan control air flow and demonstrate the sensitivity of the coating distribution to gun inlet pressure. The first pattern, for example, shows a uniform distribution of the spray pattern obtained at intermediate inlet pressures with relatively little variation in spray density from top to bottom. The second pattern shows a "center-heavy" spray distribution having sharp density transitions. The third pattern shows a "center-heavy" spray pattern obtained at low inlet pressures. Finally, the fourth pattern shows a "split" spray pattern having smooth density transitions, obtained at high inlet pressure.

The baffles 130 provide a solution to the problem of uncontrolled density transitions in the spray pattern by interposing a physical structure between the fan control apertures 114, 116 and the fluid stream discharged from the fluid aperture 106. By impinging on the fluid stream, the baffles 130 interact with and alter the cross-sectional shapes of the shaping air jets such that when the shaping jets impinge on the conical envelope of atomized fluid, the envelope is spread apart evenly with a reduced tendency to separate the spray pattern into bands of sharply varying spray density. More generally, by engaging and manipulating the shaping air jets from one or more pairs of fan control apertures 114, 116, the baffles 130 can improve operator control over pattern size, pattern shape, density, and density distribution. Further, unlike auxiliary apertures, the baffles 130 do not bleed air from the internal cavity of the air cap 104 and can therefore reduce the need for operator adjustment to inlet air pressures.

Figure 7:
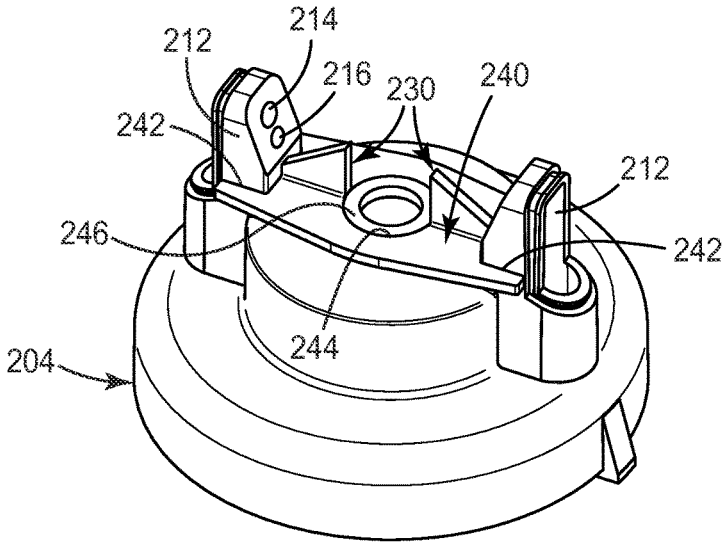
FIG. 7 is a front perspective view of a baffled nozzle assembly according to another exemplary embodiment, showing its front and side surfaces.
Figure 8:
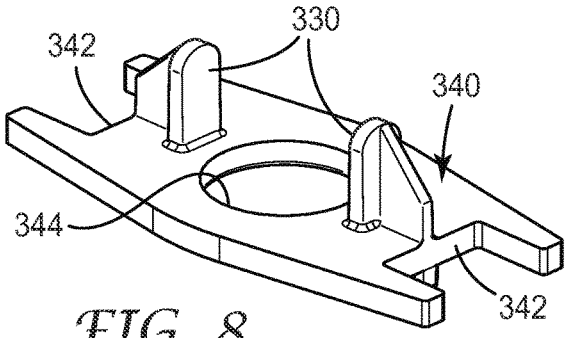
FIG. 8 is a front perspective view of an interchangeable baffled nozzle platform usable in the nozzle assembly of FIG. 7, showing its front and side surfaces.

FIG. 7 shows an embodiment in which a pair of baffles 230 are integrally mounted to a platform 240 which is releasably coupled to an external side wall of an air cap 204. FIG. 8 similarly shows an embodiment where a pair of baffles 330 with a slightly different configuration are integrally coupled to a platform 340. The platforms 240, 340 have configurations that allow for secure, yet releasable, coupling to the air cap 204. The air cap 204 in turn can be used interchangeably with the air cap 104 illustrated in FIGS. 1-5. Instead of being disposed on a platform, the baffles 230 can be directly coupled to, or integrally molded with, a side wall of the air cap 104. Depending on the application at hand, the coupling between the baffles 230 and the rest of the nozzle assembly 100 could be either releasable or permanent.

Referring again to FIGS. 7 and 8, the baffles 230, 330 are integrally molded with their respective platforms 240, 340 and the platforms 240, 340 each contain a pair of opposing notches 242, 342 that matingly engage the exterior surfaces of respective air horns 212 to secure these components to each other. Optionally and as shown in both embodiments, the platform 240, 340 further includes a hole 244, 344 that matingly engages with a protruding distal end 246 of the front-facing side wall of the air cap 204 proximate the atomizing aperture. In some embodiments, the platform 240, 340 is retained against the air cap 204 using a press fit, interference fit, or latch member to mutually secure these components. When properly seated, the notches 242, 342 register against the side wall of the air cap 204 as shown in FIG. 7, thus aligning the baffles 230, 330 with one or both pairs of fan control apertures 214, 216 to manipulate the shaping air jets during a spraying operation, as described previously.

While the platforms 240, 340 are substantially identical, the baffles 230, 330 connected to them have configurations that are slightly different. As illustrated, each of the baffles 230 only include a fin member (analogous to the fin portions 132 depicted in FIGS. 2 and 3). By contrast, each of the baffles 330 further includes a plate member (analogous to the plate portions 134 in FIGS. 2 and 3) that presents an augmented surface area to amplify the effect of the baffles 330 on the fan control air flow pattern.

Optionally, the baffles 130, 230, 330 can act in concert with one or more pairs of auxiliary air jets in manipulating the shaping air jets discharged from fan control apertures 114, 116, 214, 216. These auxiliary air jets are typically provided by forming tiny auxiliary orifices in the front face of the air cap, located for example between the atomizing aperture 108 and the air horns 112 in FIGS. 2-4. The auxiliary air jets also interact with the shaping air jets from the fan control apertures to enhance the control over the shape of the atomized fluid when discharged from the spraying apparatus 50 and mitigate sharp density transitions in the resulting spray pattern. In some embodiments, a spraying apparatus 50 using the baffles 130, 230, 330 in combination with the auxiliary orifices on the front side of the air cap provided even smoother density transitions than either the baffles 130, 230, 330 or the auxiliary orifices could provide acting alone.

As a further variant of nozzle assembly 100, for example, the air cap side wall could include a pair of auxiliary air apertures in communication with the first air passageway 120, each directing a stream of air along an auxiliary axis transverse to the air flow from a respective fan control aperture 114, 116. Optionally, each auxiliary axis intersects a volumetric shape associated a respective fan control aperture 114, 116 whereby both the baffles 130 and the auxiliary air flow act in combination to shape the air flow discharged from the fan control apertures 114, 116. Advantageously, air flowing from the auxiliary air apertures can keep the coating fluid from depositing on the air cap 104 during a spraying operation.

Figure 9:
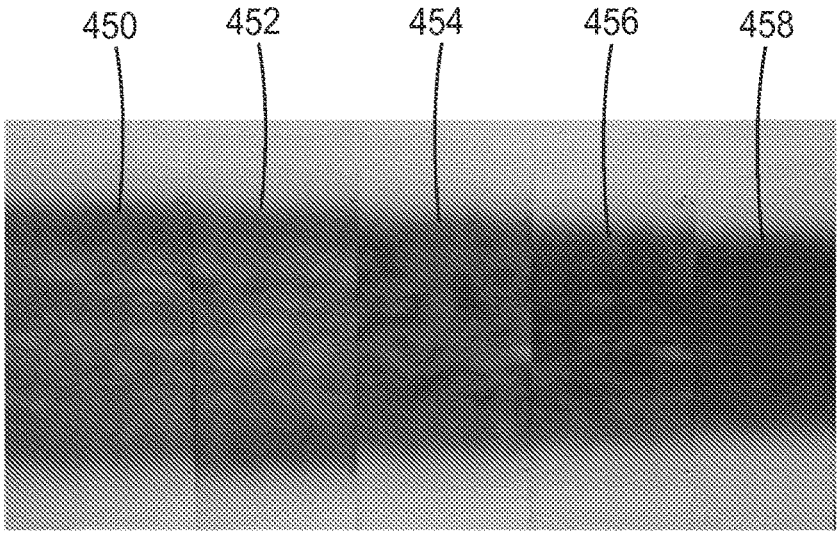
FIG. 9 is a comparison of spray patterns obtained using nozzle assemblies having different baffle configurations.

FIG. 9 shows a series of actual paint spray patterns disposed on a substrate obtained using a commercial embodiment of the spraying apparatus 50 depicted in FIG. 1. Pattern 450 was obtained using no intervening baffles, while pattern 452, pattern 454, pattern 456, and pattern 458 were obtained using a series of paired baffles, similar to the baffles 230 in FIG. 7, but having different relative heights. The results of this comparison show a significant effect of the baffles on the resulting spray pattern. As shown, the pattern 452 displayed significant density variation along vertical directions. As the baffle height increased the density variations became reduced but, at the same time, also reduced the overall height (or size) of the spray pattern (defined as "H" in FIG. 6). Depending on the application, an intermediate baffle height, represented for example by pattern 454, may provide the desired combination of spray pattern height and uniformity.

Figure 10A:
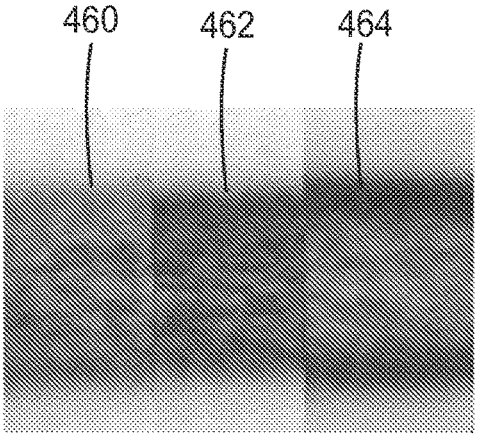
FIGS. 10A and 10B are comparisons of spray patterns obtained using the nozzle assembly of FIGS. 7-8 at different spray gun inlet pressures.

FIG. 10A shows another series of paint spray patterns, this time comparing the effect of increasing air flow through the fan control apertures on the resulting spray pattern. Patterns 460, 462, 464 in FIG. 10A corresponded to gun inlet air pressures of 15 psi, 20 psi, and 25 psi (103 kPa, 138 kPa, and 172 kPa), respectively, each obtained using a bare configuration (without any baffles). This comparison showed significant differences. First, the spray patterns 460, 462, 464 increased slightly in height with increasing air pressure. Second, spray pattern uniformity became substantially degraded with increasing air pressure, with major banding occurring in the patterns 462, 464.

Figure 10B:
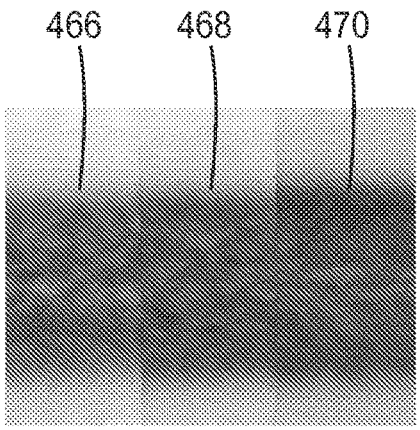

FIG. 10B repeats the above comparison but incorporates the baffle configuration used to obtain the pattern 454 in FIG. 9. Patterns 466, 468, 470 show the effect of increasing fan control air pressure on spray pattern height and uniformity, and illustrate a further benefit of using baffles in a spray gun configuration. Compared with the spray patterns 460, 462, 464 in FIG. 10A, patterns 466, 468, 470 were far more uniform at higher air pressures. While very slight banding was apparent at the highest pressures, the inclusion of baffles appeared to significantly mitigate the problem of banding.

Figure 11:
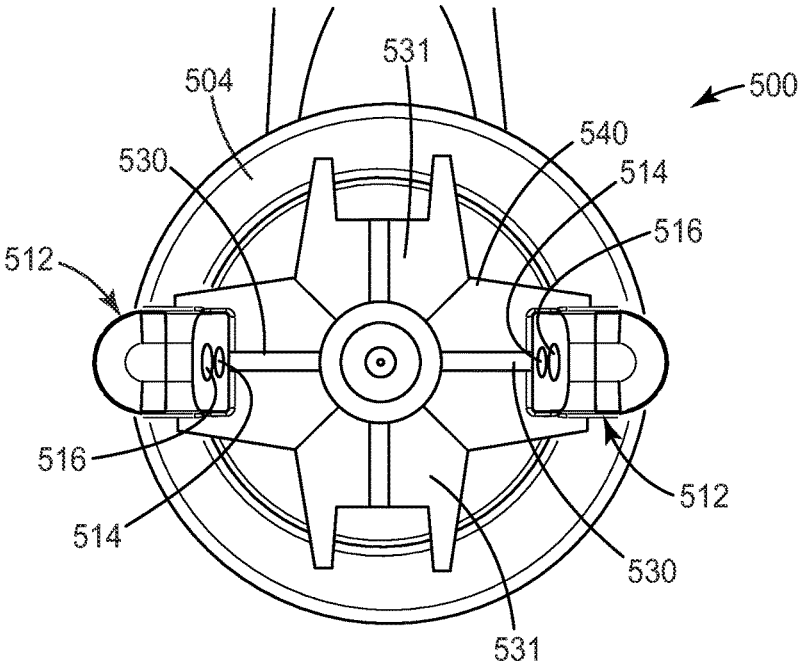
FIG. 11 is a front elevational view of a baffled nozzle platform for a nozzle assembly according to still another exemplary embodiment.

FIG. 11 shows a nozzle assembly 500 according to still another embodiment, the nozzle assembly 500 having an air cap 504 and a discrete and separable nozzle platform 540 that is releasably coupled to an external surface of the air cap 504. As shown, the nozzle platform 540 can be mounted to the front face of the air cap 504 in either of two different positions that are rotationally offset 90 degrees from each other. Further, the nozzle platform 540 includes a first pair of baffles 530 and a second pair of baffles 531 that is structurally distinct from the first pair of baffles 530. The nozzle platform 540 assumes a fixed position once mounted to the air cap 504. Between spraying operations, however, an operator has the option to select interchangeably either the first or second pair of baffles 530, 531 to modify the air flow directed from respective fan control apertures 514, 516 on air horns 512.

To enable rapid adjustments to the fan control air, the nozzle platform 500 could be further modified whereby the first or second pair of baffles 530, 531 could be selectable by merely rotating the nozzle platform 500 about the fluid axis between respective first and second positions relative to the air cap side wall. For example, the nozzle platform 540 and air cap 504 in FIG. 11 could be adapted to rotate relative to each other in 90 degree increments, and include respective mating structures that "snap" into place when the nozzle platform 540 and air cap 504 are properly registered with each other. If there is sufficient space on the nozzle platform, three or more pairs of baffles may be disposed on the same nozzle platform.

Other aspects of the nozzle assembly 500 are generally analogous to those already described and will not be repeated.

Figure 12:
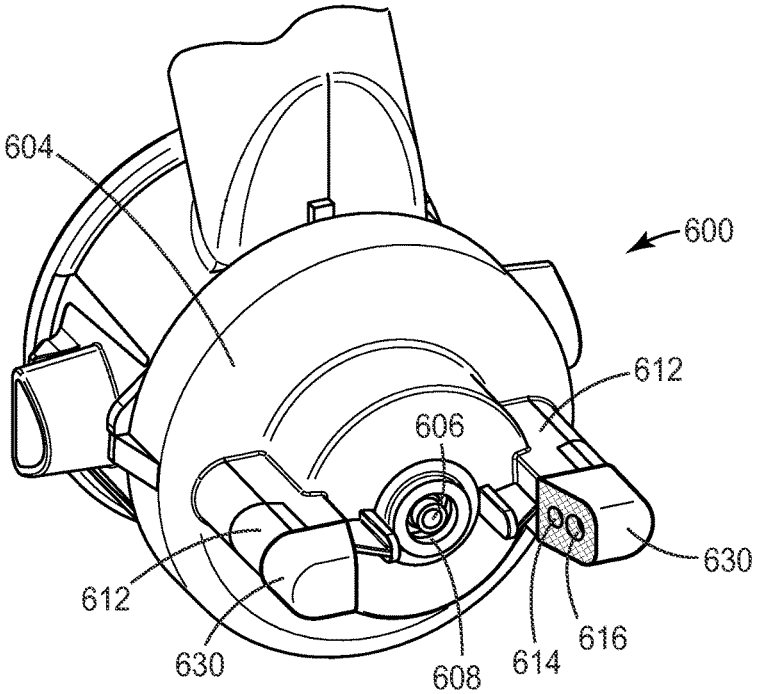
FIG. 12 is perspective view of a nozzle assembly according to yet another exemplary embodiment.

FIG. 12 shows a nozzle assembly 600 according to an embodiment that interposes porous baffles in the path of the fan control air flow. Like in assemblies previously described, the nozzle assembly 600 includes an air cap 604 having respective fluid and atomizing apertures 606, 608, a pair of air horns 612 protruding distally from the air cap 604, and respective fan control apertures 614, 616 located on the air horns 612. As shown, a pair of baffles 630 including a porous material are releasably coupled to respective air horns and restrict the fan control air after it is discharged from the fan control apertures 614, 616 but before it impinges on the fluid stream discharged from the fluid and atomizing apertures 606, 608. Optionally and as shown, the baffles 630 are placed essentially flush against the fan control apertures 614, 616. The baffles 630 can be held in place against the air cap 604 by an interference fit, latch, or any other coupling mechanism.

The baffles 630 can be made from any of a number of porous materials suitable to attenuate and/or redistribute the fan control air flow. Examples of such materials include non-wovens, meshes, open-celled foams, and combinations thereof. The porous material used in the baffles 630 is often manufactured from polymers but could also be made from metals, ceramics, or composite materials. In particularly preferred embodiments, the porous material could include a nylon mesh or highly perforated film.

Additionally, the porous material used in the baffles 630 can have any of a wide range of porosities. In some embodiments, the porous material has an open area of at least 0 percent, at least 15 percent, at least 30 percent, at least 50 percent, or at least 70 percent. Moreover, the porous material can have an open area of at most 99 percent, at most 90 percent, at most 85 percent, at most 80 percent, or at most 75 percent.

Figure 13:
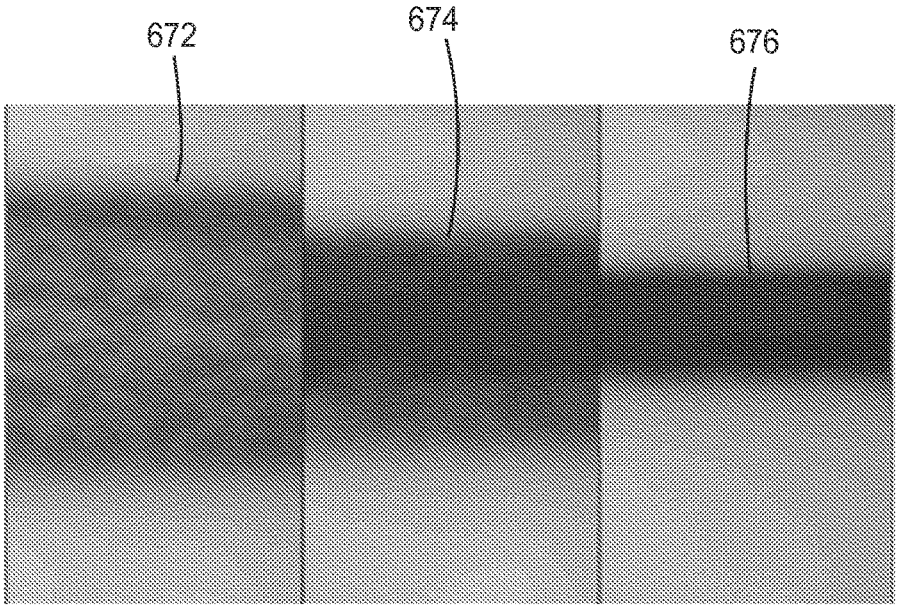
FIG. 13 is a comparison of spray patterns obtained using the nozzle assembly generally shown in FIG. 12, but using various baffle configurations.

When the fan control air is forced to flow through porous baffles, such as shown in FIG. 12, the air flow becomes attenuated. Spray patterns that result from the attenuated fan control air flow are illustrated by paint spray patterns in FIG. 13, which were obtained using a nozzle assembly having no baffles (pattern 672), a pair of highly stretched micro-replicated perforated films (pattern 674), and a pair of 125 micro woven nylon meshes (pattern 676). As shown in FIG. 13, the use of porous baffles can be highly effective in reducing spray pattern size. Advantageously, this modification in spray pattern can be achieved without need for independent adjustment of a fan control regulator on the spray gun platform (such as fan control regulator **76*b* in FIG. 1). This is, more generally, an advantage of using the aforementioned baffles 130, 230**.

Figure 15:
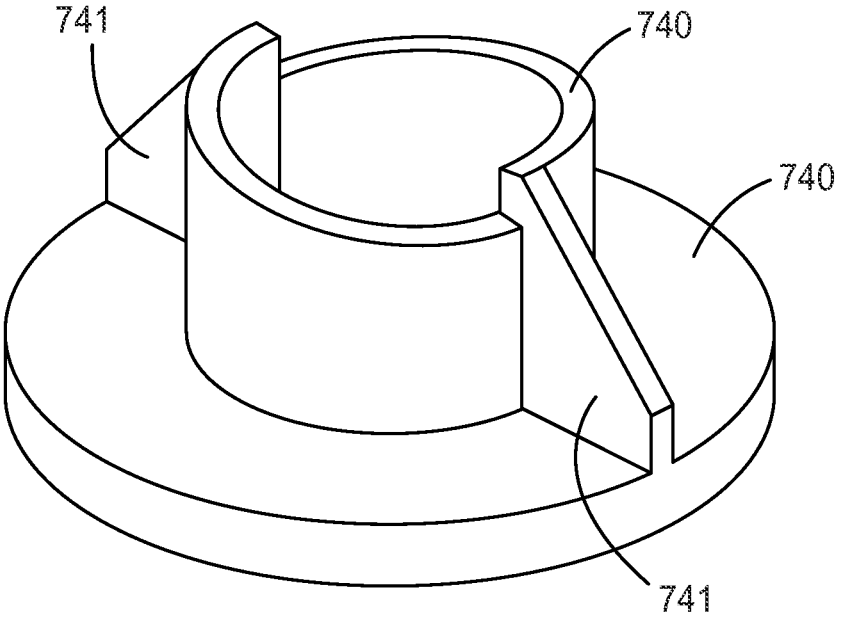
FIG. 15 is a perspective view of an interchangeable baffled nozzle platform according to yet another exemplary embodiment, showing its front and side surfaces.

As shown in FIG. 15, the provided nozzle assemblies need not have a plurality of baffles to attenuate or redirect air flow from the fan control apertures. The depicted variant includes a nozzle platform 740 that can be rotatably coupled to a suitable air cap (such as the air cap 204 in FIG. 7) with opposing air horns and respective fan control apertures as previously described. When mounted, the platform 740 has a single annular baffle 730 that projects into extruded volumetric shapes defined by respective fan control apertures (in the manner shown in FIG. 5 and described previously). Using optional tabs 741, a user can manually rotate the platform 740 about the fluid axis of the overall nozzle assembly relative to the air horns. Advantageously, the distal edge height of the annular baffle 730 varies along its circumference, enabling a user to adjust the extent to which the annular baffle projects into each volumetric shape. Optionally but not shown, the annular baffle 730 could have a flat or stepped profile. The principle of operation of the baffle 730 is otherwise similar to those of baffles previously described.

The provided nozzle assemblies and related methods may be further exemplified by the following enumerated embodiments, A-AR:

A. A nozzle assembly for a spraying apparatus including: a fluid side wall defining a fluid passageway that extends longitudinally along a fluid axis and terminates in a fluid aperture; an air cap side wall extending around the fluid side wall and partially defining a first air passageway that terminates in an atomizing aperture adjacent the fluid aperture; a pair of diametrically opposed air horns protruding past the fluid aperture from the air cap side wall and defining respective air horn cavities in communication with a second air passageway, each air horn having an external surface and a fan control aperture extending along a fan control axis through the external surface to flow air against a fluid stream discharged from the fluid aperture, where each fan control aperture has an aperture shape defined along a reference plane perpendicular to the fan control axis; and for each air horn, a baffle coupled to the air cap side wall and projecting into a volumetric shape, the volumetric shape defined by extruding the aperture shape outwardly along the fan control axis.

B. The nozzle assembly of embodiment A, where the aperture shape is a circle and the volumetric shape is a cylinder.

C. The nozzle assembly of embodiment A or B, where the atomizing aperture is an annular aperture concentric with the fluid aperture.

D. The nozzle assembly of any one of embodiments A-C, further including a spray gun interface having a configuration to releasably couple the nozzle assembly to a spray gun platform, where the first and second air passageways initiate at the spray gun interface.

E. The nozzle assembly of embodiment D, where the first and second air passageways are isolated from each other to enable a pressure differential to be maintained between the first and second air passageways.

F. The nozzle assembly of embodiment D, where the first and second air passageways communicate with each other.

G. The nozzle assembly of any one of embodiments A-F, where each baffle is releasably coupled to the external surface of its respective air horn.

H. The nozzle assembly of any one of embodiments A-F, where each baffle is releasably coupled to the air cap side wall.

I. The nozzle assembly of any one of embodiments A-F, where each baffle is an integral component of its respective air horn.

J. The nozzle assembly of any one of embodiments A-F, where each baffle is an integral component of the air cap side wall.

K. The nozzle assembly of any one of embodiments A-F, further including a nozzle platform releasably coupled to the air cap side wall, where each baffle is coupled to the nozzle platform.

L. The nozzle assembly of embodiment K, where the nozzle platform includes a pair of opposing notches, each notch engaging the external surface of a respective air horn to secure the nozzle platform against the air cap side wall.

M. The nozzle assembly of embodiment K or L, where the baffles represent a first pair of baffles and further including a second pair of baffles coupled to the nozzle platform, the first and second pairs of baffles being interchangeable to modify the air flow from the fan control aperture.

N. The nozzle assembly of embodiment M, where the nozzle platform is rotatably coupled to the air cap side wall and either the first or second pair of baffles is selectable by rotating the nozzle platform about the fluid axis between respective first and second positions relative to the air cap side wall.

O. The nozzle assembly of any one of embodiments A-N, where each baffle includes a fin portion extending radially along the air cap side wall and coplanar with the fluid axis.

P. The nozzle assembly of embodiment O, where each baffle further includes a plate portion connected to the fin portion, the plate portion facing the air flow from its respective fan control aperture.

Q. The nozzle assembly of any one of embodiments A-P, where each baffle occludes 1 percent to 100 percent of a cross-section of the volumetric shape as viewed along directions parallel respective fan control axis.

R. The nozzle assembly of embodiment Q, where each baffle occludes 1 percent to 40 percent of the cross-section of the volumetric shape as viewed along directions parallel respective fan control axis.

S. The nozzle assembly of embodiment R, where each baffle occludes 1 percent to 20 percent of the cross-section of the volumetric shape as viewed along directions parallel respective fan control axis.

T. The nozzle assembly of any one of embodiments A-P, where each baffle protrudes into its respective volumetric shape by an amount ranging from 1 percent to 100 percent of the diameter of its respective fan control aperture.

U. The nozzle assembly of embodiment T, where each baffle protrudes into its respective volumetric shape by an amount ranging from 1 percent to 50 percent of the diameter of its respective fan control aperture.

V. The nozzle assembly of embodiment U, where each baffle protrudes into its respective volumetric shape by an amount ranging from 1 percent to 30 percent of the diameter of its respective fan control aperture.

W. The nozzle assembly of any one of embodiments A-N, where each baffle includes a porous material that at least partially restricts the air flow from its respective fan control aperture.

X. The nozzle assembly of embodiment W, where the porous material includes a non-woven material.

Y. The nozzle assembly of embodiment W, where the porous material includes an open-celled foam.

Z. The nozzle assembly of any one of embodiments W-Y, where the porous material has an open area ranging from 0 percent to 99 percent.

AA. The nozzle assembly embodiment Z, where the porous material has an open area ranging from 50 percent to 99 percent.

AB. The nozzle assembly embodiment AA, where the porous material has an open area ranging from 70 percent to 99 percent.

AC. The nozzle assembly of any one of embodiments A-AB, where each fan control axis intersects a respective baffle.

AD. The nozzle assembly of any one of embodiments A-AC, where each fan control aperture is an inner fan control aperture and where each air horn further includes an outer fan control aperture adjacent the inner fan control aperture and extending along an outer fan control axis.

AE. The nozzle assembly of embodiment AD, where each reference plane is a first reference plane and each outer fan control aperture has a second aperture shape defined along a second reference plane perpendicular its outer fan control axis, and where for each air horn, no baffle projects into a volumetric shape defined by extruding the second aperture shape outwardly along its outer fan control axis.

AF. The nozzle assembly of embodiment AE, where the first and second reference planes are generally coplanar.

AG. The nozzle assembly of any one of embodiments A-AF, where the air cap side wall includes a pair of auxiliary air apertures in communication with the second air passageway, each directing a stream of air along an auxiliary axis transverse to the air flow from a respective fan control aperture.

AH. The nozzle assembly of embodiment AG, where each auxiliary axis intersects a volumetric shape associated with one of the fan control apertures.

AI. A nozzle assembly for a spraying apparatus including: a fluid side wall defining a fluid passageway that extends longitudinally along a fluid axis and terminates in a fluid aperture; an air cap side wall extending around the fluid side wall and partially defining a first air passageway that terminates in an atomizing aperture adjacent the fluid aperture; a pair of diametrically opposed air horns protruding past the fluid aperture from the air cap side wall and defining respective air horn cavities in communication with a second air passageway, each air horn having an external surface and a fan control aperture extending along a fan control axis through the external surface to flow air against a fluid stream discharged from the fluid aperture, where each fan control aperture has an aperture shape defined along a reference plane perpendicular to the fan control axis; and an annular baffle rotatably coupled to the air cap side wall and projecting into a pair of volumetric shapes, each volumetric shape defined by extruding each aperture shape outwardly along its respective fan control axis.

AJ. The nozzle assembly of embodiment AL, where the annular baffle projects into each volumetric shape to an extent that varies as the annular baffle is rotated about the fluid axis relative to the air horns.

AK. A method of adjusting a spray pattern of a spraying apparatus having a fluid aperture and a pair of diametrically opposed air horns projecting past the fluid aperture, each air horn including a fan control aperture, the method including: providing a pair of baffles extending outwardly from the spraying apparatus adjacent to respective air horns, where each baffle extends into a volumetric shape defined by extruding the shape of its respective fan control aperture outwardly along its fan control axis; and discharging a fluid stream from the fluid aperture while simultaneously flowing air from the fan control apertures against the fluid stream from opposing directions, where the pair of baffles modify the flowing air before the air impinges against the fluid stream, thereby producing a modified spray pattern.

AL. The method of embodiment AK, where each baffle includes a fin portion extending parallel to the air flow from its respective fan control aperture.

AM. The method of embodiment AL, where each baffle further includes a plate portion connected to the fin portion, the plate portion facing the air flow from its respective fan control aperture.

AN. The method of any one of embodiments AK-AM, where the modified spray pattern includes a spray pattern having reduced density variations as compared to an unmodified spray pattern.

AO. The method of any one of embodiments AK-AN, where the modified spray pattern includes a spray pattern having a larger or smaller size.

AP. The method of embodiment AK, AN, or AO, where each baffle includes a porous material that at least partially restricts the air flow from its respective fan control aperture.

AQ. The method of any one of embodiments AK-AP, where the modified spray pattern is obtained independently of any adjustments in air inlet pressure.

AR. The method of any one of embodiments AK-AQ, where the fluid stream is atomized by air flowing through an air passageway that is in communication with each of the fan control apertures.

EXAMPLES

Unless stated otherwise, the following components and materials, described according to their respective trade designations and part numbers, were obtained from 3M Company, St. Paul, Minn.

The following abbreviations are used to describe the examples:

cm: centimeters
ipm: inches per minute
kPa: KiloPascals
mil: $10^{-3}$ inches
mL: milliliter
mm: millimeters
μm: micrometer
m/min: meters per minute
psi: Pounds per square inch
Std. Dev.: Standard deviation Comparative A "PPS" 600 mL paint gun cup, Part No. 16122, with a 200 μm filter, lid and liner assembly, Part No. 16300, was filled with a water-based black paint, obtained under the trade designation "ENVIROBASE T407" from PPG Industries, Inc., Pittsburgh, Pa. A model "ACCUSPRAY HG18 SPRAY GUN, PART No. 16570", having a "1.8 mm ATOMIZING HEAD, PART No. 16611", was connected to the gun cup assembly, which in turn was attached to an automated spray painting machine, model "310940" from Spraymation, Inc., Fort Lauderdale, Fla. A spray pattern, approximately 12 by 20 inch (30.5 by 50.8 cm), was then applied to a white paperboard substrate, type "WHITE TANGO C1S" obtained from MeadWestvaco Corporation, Richmond, Va., under the following conditions:

Spray Gun Inlet Pressure: 20 psi (137.9 kPa)
Shaping Air Valve: Fully open
Fluid Shaping Valve: Fully open
Spray Gun-to-Panel Distance: 8 inches (20.32 cm)
Spray Gun Traverse Speed: 800 ipm (20.32 m/min)

Example 1

An exemplary baffle platform of the present invention, having a rectangular baffle plate with a 50 mil (1.27 mm) radial apex, 100 mil (2.54 mm) width and 190 mil (4.83 mm) height, as shown in FIG. 8, was press-fitted around the air horns and flush with the spray outlet orifice of the spray gun nozzle. A spray pattern was then generated as generally described in the Comparative.

Example 2

The process as described in Example 1 was then repeated, wherein the exemplary baffle plate was substituted for one having baffle plate height of 210 mil (5.33 mm).

Figure 14:
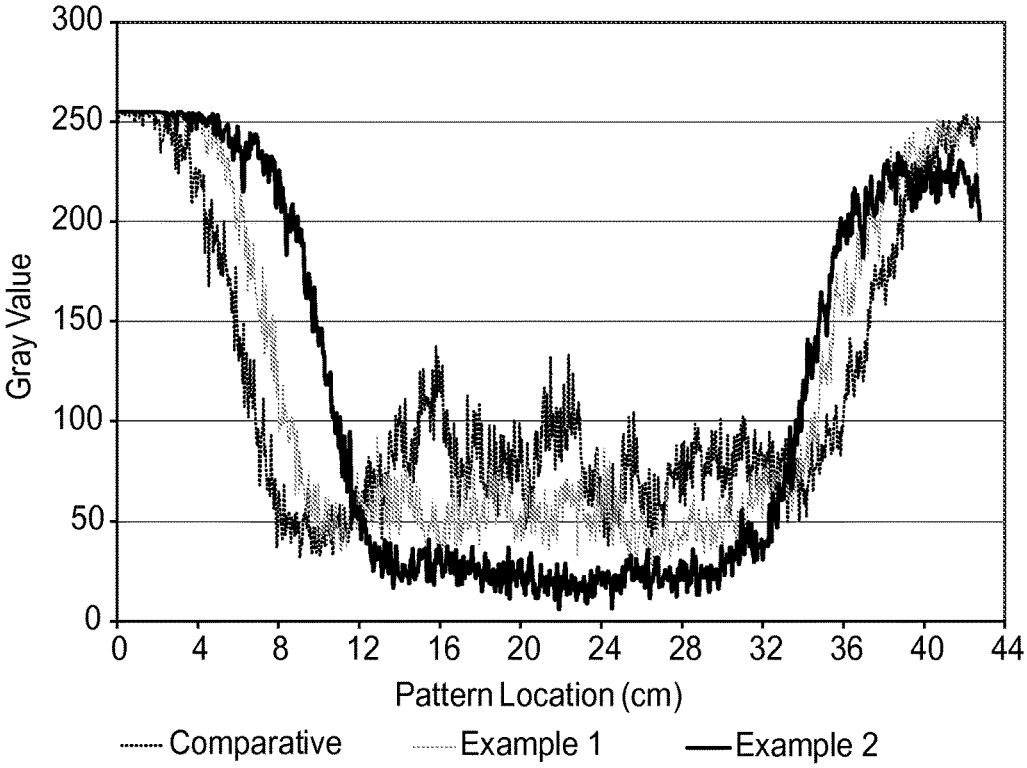
FIG. 14 is a chart showing measured spray pattern density as a function of lateral location along a test substrate.

Digital images of the spray patterns were taken using model "OPTIO E90" digital camera from Pentax Corporation, and saved as a "jpeg" file. Using the image processing software "IMAGEJ", the pixel gray values (pgv) were subsequently measured across the width of each spray pattern. Pattern size corresponds to the width of the spray pattern at a pgv of ≤200. The outer boundaries of the central portion correspond to where the gpv generally reaches a local minimum when approached from the edges of the spray pattern. Within the central portion the minimum and maximum pgv were recorded and the standard deviation of the pvg range determined. The Results are represented graphically in FIG. 14, while the data are listed in Table 1.

TABLE 1

| Baffle Dimensions | Pixel Gray Value | | | |
|---|---|---|---|---|
| (mm) | Minimum | Maximum | Range | Std. Dev. |
| Comparative | 32 | 138 | 106 | 19 |
| Example 1 | 26 | 93 | 67 | 11 |
| Example 2 | 6 | 42 | 36 | 6 |

All patents and patent applications mentioned above are hereby expressly incorporated by reference. Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. A nozzle assembly for a spraying apparatus comprising:

a fluid side wall defining a fluid passageway that extends longitudinally along a fluid axis and terminates in a fluid aperture;

an air cap side wall extending around the fluid side wall and partially defining a first air passageway that terminates in an atomizing aperture adjacent the fluid aperture;

a pair of diametrically opposed air horns protruding past the fluid aperture from the air cap side wall and defining respective air horn cavities in communication with a second air passageway, each air horn having an external surface and a fan control aperture extending along a fan control axis through the external surface to flow air against a fluid stream discharged from the fluid aperture, wherein each fan control aperture has an aperture shape defined along a reference plane perpendicular to the fan control axis; and for each air horn, a baffle coupled to the air cap side wall and projecting into a volumetric shape, the volumetric shape defined by extrapolating the aperture shape outwardly along the fan control axis, where the volumetric shape has parallel side walls when viewed perpendicular to the fan control axis.

2. The nozzle assembly of claim 1, wherein each baffle is releasably coupled to the external surface of its respective air horn.

3. The nozzle assembly of claim 1, wherein each baffle is releasably coupled to the air cap side wall.

4. The nozzle assembly of claim 1, further comprising a nozzle platform releasably coupled to the air cap side wall, wherein each baffle is coupled to the nozzle platform.

5. The nozzle assembly of claim 4, wherein the nozzle platform includes a pair of opposing notches, each notch engaging the external surface of a respective air horn to secure the nozzle platform against the air cap side wall.

6. The nozzle assembly of claim 4, wherein the baffles represent a first pair of baffles and further comprising a second pair of baffles coupled to the nozzle platform, the first and second pairs of baffles being interchangeable to modify the air flow from the fan control aperture.

7. The nozzle assembly of claim 6, wherein the nozzle platform is rotatably coupled to the air cap side wall and either the first or second pair of baffles is selectable by rotating the nozzle platform about the fluid axis between respective first and second positions relative to the air cap side wall.

8. The nozzle assembly of claim 1, wherein each baffle comprises a fin portion extending radially along the air cap side wall and coplanar with the fluid axis.

9. The nozzle assembly of claim 8, wherein each baffle further comprises a plate portion connected to the fin portion, the plate portion facing the air flow from its respective fan control aperture.

10. The nozzle assembly of claim 1, wherein each baffle occludes 1 percent to 20 percent of a cross-section of the volumetric shape as viewed along directions parallel respective fan control axis.

11. The nozzle assembly of claim 1, wherein each baffle protrudes into its respective volumetric shape by an amount ranging from 1 percent to 30 percent of a distance across the respective fan control aperture.

12. The nozzle assembly of claim 1, wherein each baffle comprises a porous material that at least partially restricts the air flow from its respective fan control aperture.

13. A nozzle assembly for a spraying apparatus comprising:

a fluid side wall defining a fluid passageway that extends longitudinally along a fluid axis and terminates in a fluid aperture;

an air cap side wall extending around the fluid side wall and partially defining a first air passageway that terminates in an atomizing aperture adjacent the fluid aperture;

a pair of diametrically opposed air horns protruding past the fluid aperture from the air cap side wall and defining respective air horn cavities in communication with a second air passageway, each air horn having an external surface and a fan control aperture extending along a fan control axis through the external surface to flow air against a fluid stream discharged from the fluid aperture, wherein each fan control aperture has an aperture shape defined along a reference plane perpendicular to the fan control axis; and an annular baffle rotatably coupled to the air cap side wall and projecting into a pair of volumetric shapes, each volumetric shape defined by extrapolating each aperture shape outwardly along its respective fan control axis, where the volumetric shape has parallel side walls when viewed perpendicular to the fan control axis.

14. The nozzle assembly of claim 13, wherein the annular baffle projects into each volumetric shape to an extent that varies as the annular baffle is rotated about the fluid axis relative to the air horns.

* * * * *